US005217835A

United States Patent [19]

Watanabe et al.

[11] Patent Number: 5,217,835

[45] Date of Patent: Jun. 8, 1993

[54] TWO-COMPONENT DEVELOPER FOR USE IN DRY DEVELOPMENT OF ELECTROSTATIC PATTERN

[75] Inventors: Akihiro Watanabe, Neyagawa; Tsutomu Uezono, Sagamihara; Mitsushi Kuroki, Kumamoto; Yoshihisa Kuramae, Hirakata; Naruo Yabe, Kobe, all of Japan

[73] Assignee: Mita Industrial Co., Ltd., Osaka, Japan

[21] Appl. No.: 758,468

[22] Filed: Sep. 6, 1991

Related U.S. Application Data

[63] Continuation of Ser. No. 558,237, Jul. 26, 1990, abandoned.

[30] Foreign Application Priority Data

Jul. 28, 1989 [JP] Japan ..... 1-194058

[51] Int. Cl.[5] ..... G03G 9/083

[52] U.S. Cl. ..... 430/106.6; 430/108; 430/111; 430/122

[58] Field of Search ..... 430/106.6, 108, 111, 430/122

[56] References Cited

U.S. PATENT DOCUMENTS 4,968,573 11/1990 Kaneko et al. ..... 430/106.6

*Primary Examiner*—Marion E. McCamish
*Assistant Examiner*—S. Rosasco
*Attorney, Agent, or Firm*—Wenderoth, Lind & Ponack

[57] ABSTRACT

A two-component developer for use in dry development of electrostatic charge pattern, comprising a mixture of magnetic carrier particles and electroscopic toner particles, characterized in that said magnetic carrier particles have a relaxation time B (msec) satisfying the equation $0<B<20$ when they are situated in a dynamic state and said developer has a relaxation time A (msec) satisfying the equation: $0.35B+11<A<0.35B+14$ when it is situated in a dynamic state.

2 Claims, 5 Drawing Sheets

TWO-COMPONENT DEVELOPER FOR USE IN DRY DEVELOPMENT OF ELECTROSTATIC PATTERN

This application is a continuation of now abandoned U.S. application Ser. No. 558,237, filed Jul. 26, 1990.

FIELD OF THE INVENTION

The present invention relates to a two-component developer for dry development of electrostatic pattern in electrophotography (this two-component developer will be hereinafter referred to as "dry two-component developer"). More particularly, it relates to an improved dry two-component developer which makes it possible to provide sufficiently sharp development of minute lines and dots and also to provide highly dense development of solid black area.

BACKGROUND OF THE INVENTION

There are known a number of two-component developers comprising magnetic carriers and toner particles for use in various electrophotographic copying machines. For the image-development using such two-component developer in the electrophotographic copying machine, bristles of a magnetic brush are formed on the surface of a developing sleeve provided with a magnetic pole, and said magnetic brush is contacted with the electrostatic latent image formed on an electrophotographic photosensitive member to thereby form a toner image.

The use of ferrite particles as the magnetic carriers of the developer is well known. For example, Japanese Laid-Open Sho. 60(1985)-170863 discloses a two-component developer containing magnetic carriers comprising ferrite particles of $5\times10^7\Omega\cdot$cm in specific resistance and of 50 to 120 $\mu$m in mean particle size. The publication states that the two-component developer is effective to develop solid black areas with a uniform density without reducing resolution.

However, the two-component developer proposed by the foregoing Japanese publication is still problematic that it is not satisfactory in development of minute lines and dots. That is, for example, when an original containing multi-minute lines is reproduced with the use of said developer, the resulting image often becomes such that is not equivalent to the original since some of reproduced minute lines are wider or thinner than the original minute lines and accompanied by blank area. Further, Japanese Laid-Open Sho. 63(1988)-313174 discloses an electrophoto-graphic image-forming process wherein a toner image is formed by way of a so-called non-contact development using magnetic carrier particles each of which having a coat comprising an insulating material on the surface thereof and satisfying the equation: $30\leqq M\leqq -0.8R+150 (10\leqq R\leqq 150)$ wherein M represents a magnetic intensity (emu/cm$^3$) which was measured in the magnetic field of 1000 oersted and R represents a mean particle size ($\mu$m). This proposal is meaningful in the viewpoint that the existence of a specific interrelation between the magnetic intensity of the magnetic carrier and the particle size thereof. However, when the foregoing magnetic carrier particles are used in image-development of the electrophotographic image-forming process, it is difficult to match those magnetic particles with toner particles as desired. Thus, any of the foregoing proposals is directed to magnetic carrier particles for use in electrophotographic developers and those magnetic carrier particles are ones that have characteristics specified by the static condition but not by the dynamic condition which is necessary to be considered with respect to their characteristics upon contact of the developer's magnetic brush formed on the surface of the developing sleeve with the surface of the photbsensitive member.

Any of these known two-component developers is not sufficient to meet an increased demand for provision of an improved two-component developer which makes it possible to reproduce a desirable high quality image from an original containing multi-minute lines such as complicated chinese characters and black solid areas, which is not accompanied by any missing part and which excels in resolution and density (optical density).

SUMMARY OF THE INVENTION

The present invention is aimed at providing an improved dry two-component developer for use in electro-photography which is capable of providing sufficiently sharp development of minute lines and dots and is also capable of providing highly dense development of solid black area.

Another object of the present invention is to provide an improved dry two-component developer which is usable in various electrophotographic image-forming systems utilizing magnetic brush phenomenon.

A further object of the present invention is to provide an improved dry two-component developer for use in electrophotography which excels in charge retentivity, which slightly causes dispersion of toner particles and which excels in durability.

The dry two-component developer for use in electrophotography to be provided according to the present invention which attains the foregoing objects comprises a mixture composed of magnetic carrier particles and electroscopic toner particles (hereinafter referred to as "toner particles" in short) and satisfies the equation: $0.35B+11<A<0.35B+14$ with B being $0<B<20$, wherein A represents a relaxation time (msec) of the developer in a dynamic state and B represents a relaxation time (msec) of the magnetic carrier particle in a dynamic state. The dry two-component developer of the present invention is characterized by using specific magnetic carrier particles which satisfy the equation: $0.3D+18<M<0.3D+28$, wherein D represents a mean particle size ($\mu$m) and M represents a saturation magnetization (emu/g).

DETAILED DESCRIPTION-INCLUDING PREFERRED EMBODIMENTS

The present inventors have made earnest studies for overcoming the foregoing problems in the known dry two-component developer and for attaining the objects as described above, and as a result, have experimentally found a fact that desirable reproduction of minute lines and high density reproduction of a black solid area can be desirably and effectively attained when a selected dry two-component developer comprising magnetic carrier particles and toner particles, the relaxation time of which in a dynamic state being in a specific range with respect to the relaxation time of the magnetic carrier particle in a dynamic state, is used as the developer in the electrophotographic image-forming system. The present invention has been accomplished based on this finding.

The term "relaxation time in a dynamic state" means the relaxation time of the magnetic carrier particle or the developer when said magnetic carrier particle or said developer is situated in a state of forming a magnetic brush on a developing sleeve while moving in a developing mechanism of the electrophotographic image-forming system.

Figure 1:
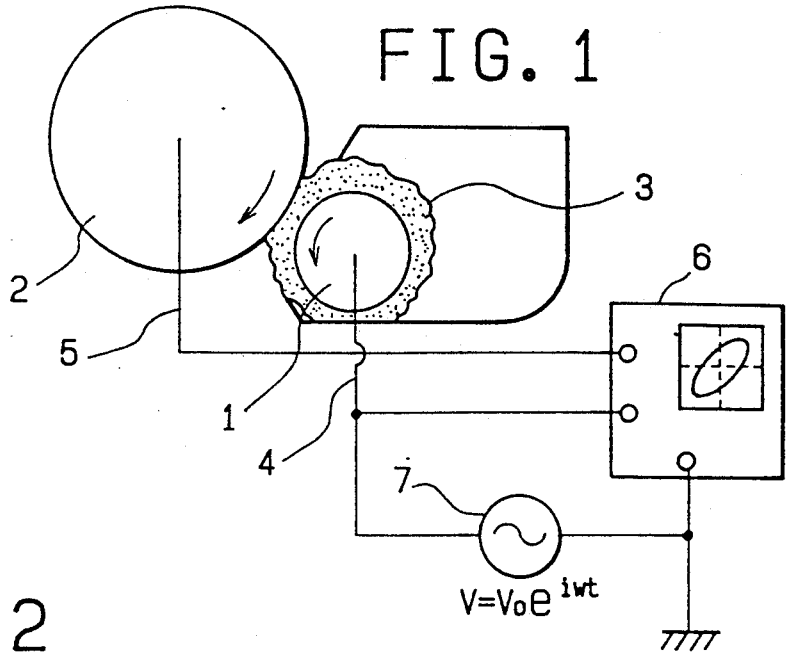
FIG. 1 is a schematic diagram illustrating the constitution of an experimental electrophotographic copying machine for measuring the relaxation time of a particle.
Figure 2:
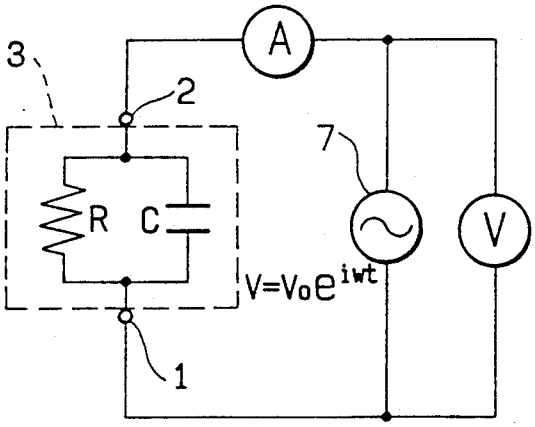
FIG. 2 is a schematic view showing the details of the electric circuit in the machine shown in FIG. 1.

The relaxation time of the magnetic carrier particle or the developer is measured by using a partial modification of a commercially available electrophotographic copying machine DC-2585 (product by Mita Industrial Co., Ltd.) for use in experimental purposes in which the photosensitive selenium drum is replaced by a conductive drum 2 having an electrode surface made of brass and a measuring electric circuit system is provided as shown in FIG. 1. FIG. 2 is a schematic view illustrating the constitution of said measuring electric circuit system.

In FIGS. 1 and 2, numeral reference 1 stands for a developing sleeve provided with a magnetic pole therein (not shown). Numeral reference 2 stands for a conductive drum of the same shape and the same size as those of the photosensitive drum. Numeral reference 3 stands for a layer region composed of a two-component developer comprising magnetic carrier particles and toner particles or a layer region composed of said magnetic carrier particles which is formed in the space between the exterior of the conductive drum 2 and the exterior of the developing sleeve 1.

The conductive drum 2 and the developing sleeve 1 are rotated respectively at the nip position and in the direction expressed by an arrow. Numeral reference 6 stands for a measuring digital oscillograph. The developing sleeve 1 is electrically connected through a lead wire 4 to the oscillograph 6. Likewise, the conductive drum 2 is electrically connected through a lead wire 5 to the oscillograph 6.

Numeral reference 7 stands for an AC power source to which the developing sleeve 1 is electrically connected through the lead wire 4.

The relaxation time of the developer or the magnetic carrier particle is measured in the following manner. That is, the developing sleeve 1 and the conductive drum 2 are rotated; the AC power source 7 is switched on to apply an AC voltage of 50 Hz between said developing sleeve 1 and conductive drum 2 being rotating, where a voltage and an electric current are provided by the oscillogrph 6; and a phase difference between the resultant voltage and the resultant electric current is calculated to obtain a relaxation time ($\tau$) of the developer or the magnetic carrier particle.

Figure 3:
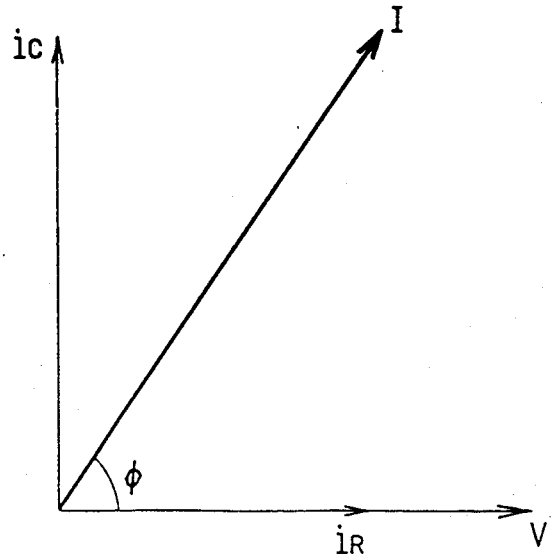
FIG. 3 shows a graph obtained when an alternating voltage was applied onto the electric circuit shown in FIG. 2.

In more detail of this respect, as shown in FIG. 1, there exists the layer region 3 composed of the two-component developer or the magnetic carrier particles at the nip position between the developing sleeve 1 and the conductive drum 2. Said layer region 3 can be approximated that a constant electrostatic capacity C and a constant electric resistance R are connected in parallel as shown in FIG. 2. When an AC voltage is applied onto this electric circuit, an electric current I is provided in the way as shown in FIG. 3. That is, an electric current iR flown to a resistance R (in FIG. 2) is of the same phase as the voltage V. On the other hand, a electric current iC flown to a capacitor C (in FIG. 2) is of the phase exceeding the voltage V by 90°. Thus, it is understood that the entire electric current I is of the phase exceeding the voltage V by a value $\phi$.

In view of this, the foregoing relaxation time ($\tau$) in this electric circuit can be obtained by the equation: $\tau = \tan \phi/\omega$, wherein $\phi$ represents a phase difference between the voltage and the electric current and $\omega$ represents an angular frequency of the AC power generated from the AC power source wherein $\omega = 2\pi f$, with f being a frequency.

The dry two-component developer for use in electrophotography according to the present invention is constituted by specific toner particles and specific magnetic carrier particles which are selected in combination such that the relaxation time (A) obtained in the way above mentioned of the resulting dry two-component developer in a dynamic state becomes to satisfy the following equation (1), wherein the relaxation time (B) obtained in the way above mentioned of said magnetic carrier particles in a dynamic state satisfies the following equation (2):

$$0.35B + 11 < A < 0.35B + 14 \ldots \quad (1)$$

$$0 < B < 20 \ldots \quad (2).$$

Because of this, the dry two-component developer for use in electrophotography according to the present invention excels in resolution and tone reproduction. Particularly when an original containing close minute lines such as complicated chinese characters and solid black areas is used for reproduction, the resulting copied image becomes such that those complicated chinese characters are desirably reproduced with a high resolution without any missing part and solid black areas are reproduced with a desirably uniform optical density.

The present invention has been accomplished based on the facts obtained as a result of experiments by the present inventors, which will be described in the following.

EXPERIMENT 1

Preparation of Resin-coated Carrier Particles

There were provided 24 kinds of ferrite particles (Sample Nos. 1 to 24) respectively having the characteristics shown in Table 1.

There were provided silicone resin (straight silicone resin)(hereinafter referred to as "resin A"), acrylic resin (MMA-BA copolymer)(hereinafter referred to as "resin B"), fluorine plastic (mixed resin of polyvinylidene chloride and St-MMA copolymer)(hereinafter referred to as "resin C"), styrene resin (hereinafter referred to as "resin D") and styrene-acrylic resin (styrene-n-butylacrylate copolymer)(hereinafter referred to as "resin E").

Each of the ferrite particle Samples 1 to 24 was applied with a coat comprising one of said resins A to E in a predetermined amount by applying a coating composition containing said resin onto the ferrite particles, followed by drying with the use of a fluidized bed coating device. The resultants were baking-finished at a temperature of 80° to 100° C. and subjected to disintegrating granulation, to thereby obtain coated carrier particles. In this way, there were prepared resin-coated carrier particles for each of the ferrite particle samples Nos. 1 to 24. Thus, there were obtained 24 kinds of resin-coated carrier particle samples Nos. 1 to 24.

Then, the mean relaxation time of each resultant resin-coated carrier particles in a dynamic state was examined in accordance with the foregoing relaxation time measuring method with the use of the apparatus shown in FIG. 1.

The above situations and measured results were collectively shown in Table 1.

Preparation of Toner Particles

There were prepared three kinds of toner particles (Toner Sample 1, Toner Sample 2 and Toner Sample 3).

Preparation of Toner Sample 1

There was provided a composition composed of:

| | | |
|---|---|---|
| (a) | styrene-acryl copolymer (comprised of styrene monomer and n-butylmethacrylate monomer by the ratio of 7:3) of $5.7 \times 10^{10}$ in conductivity | 100 parts by weight, |
| (b) | carbon black of 300 $m^2/g$ in specific surface and 92 cc/100g in DBP oil absorption | 8 parts by weight versus the amount of said copolymer (a), |
| (c) | metal-containing azo dye | 2 parts by weight versus the amount of said copolymer (a), and |
| (d) | low molecular polypropylene as the lubricant | 1.5 parts by weight versus the amount of said copolymer (a). |

The composition was melt-blended, cooled, pulverized and classified, to thereby obtain toner particles of 10.5 μm in mean particle size, $2.2 \times 10^9$ in conductivity, 3.2 in dielectric constant and 13 in relaxation time (Toner Sample 1).

Preparation of Toner Sample 2

The procedures of preparing Toner Sample 1 were repeated, except that the styrene-acrylonitrile copolymer was replaced by other styrene-acrylonitrile copolymer of $7.4 \times 10^{10}$ in conductivity, to thereby obtain toner particles of 10.5 μm in mean particle size, $3.2 \times 10^9$ in conductivity, 3.3 in dielectric constant and 9.5 in relaxation time (Toner Sample 2).

Preparation of Toner Sample 3

The procedures of preparing Toner Sample 1 were repeated, except that the amount of the carbon black was increased to 10 parts by weight, to thereby obtain toner particles of 10.5 μm in mean particle size, $3.9 \times 10^9$ in conductivity, 3.5 in dielectric constant and 7.9 in relaxation time (Toner Sample 3).

Preparation of Two-Component Developers

There were prepared 24 kinds of two-component developers (Developer Samples Nos. 1 to 24) respectively having a toner content of 2.8% by weight by mixing each of the foregoing ferrite particle Samples 1 to 24 with the foregoing Toner Sample 1.

Image-Formation Test

Image-formation was performed with the use of each of the resultant Developer Samples Nos. 1 to 24 in a commercially available Electrophotographic Copying Machine DC-2585 of forward developing-type (product by Mita Industrial Co., Ltd.) under the process conditions of the surface potential of the photosensitive drum: 800 V; the magnetic brush bristle's interval: 1.0 mm; the distance between the developing sleeve and the photosensitive drum: 1.2 mm; the pherical speed ratio between the developing sleeve and the photbsensitive drum: 2.73; and the intensity of the developing magnet: 800 Gauss. As a result, it was found that each of the Developer Samples Nos. 3 and 15 respectively having a resin coated carrier particle of more than 20 in the dynamic state relaxation time provides unsatisfactory copied images of 1.15 to 1.25 in optical density but any of the remaining samples provides satisfactory copied images exceeding 1.25 in optical density.

Experiment 2

The resin coated carrier sample No. 3 obtained in Experiment 1 was mixed with the toner sample 2 to thereby obtain a two-component developer A having a toner content of 2.8% by weight.

The resin coated carrier sample No. 3 obtained in Experiment 1 was mixed with the toner sample 3 obtained in Experiment 1 to thereby obtain a two-component developer B having a toner content of 2.8% by weight.

The resin coated carrier sample No. 15 obtained in Experiment 1 was mixed with the toner sample 2 to thereby obtain a two-component developer C having a toner content of 2.8% by weight.

The resin coated carrier sample No. 15 obtained in Experiment 1 was mixed with the toner sample 3 obtained in Experiment 1 to thereby obtain a two-component developer D having a toner content of 2.8% by weight.

Image-formation test was conducted with respect to each of the resultant two-component developers A to D in the same manner as in Experiment 1.

As a result, it was found that any distinguishable improvement is not recognized in any of the four cases. improvement is not recognized in any of the four cases.

In view of the experimental results obtained, it was recognized that in the case of using a resin-coated magnetic carrier having a relaxation time of more than 20, even though a toner having a reduced relaxation time is used, the resulting two component developer becomes such that provides unsatisfactory copied images. The reason for this is that charges are greatly trapped within said magnetic carrier and they are hardly mobilized therefrom at the developing region of the image-forming process and because of this, toner is hindered to transfer to latent image formed on the photosensitive drum.

From these results, it was recognized that the magnetic carrier of the two-component developer is necessary to have a specific relaxation time in a dynamic state in order to obtain desirable copied images having a satisfactory optical density.

Experiment 3

There were prepared 24 kinds of two-component developers (developer samples Nos. 1 to 24) respectively having a predetermined toner content by mixing one of the 24 kinds of the resin-coated carrier particle samples obtained in Experiment 1 with one of the three kinds of toner samples 1 to 3 as shown in Table 2. Samples Nos. 1 to 24 was examined by the foregoing relaxation time-measuring method to obtain the value shown in Table 2.

Figure 6:
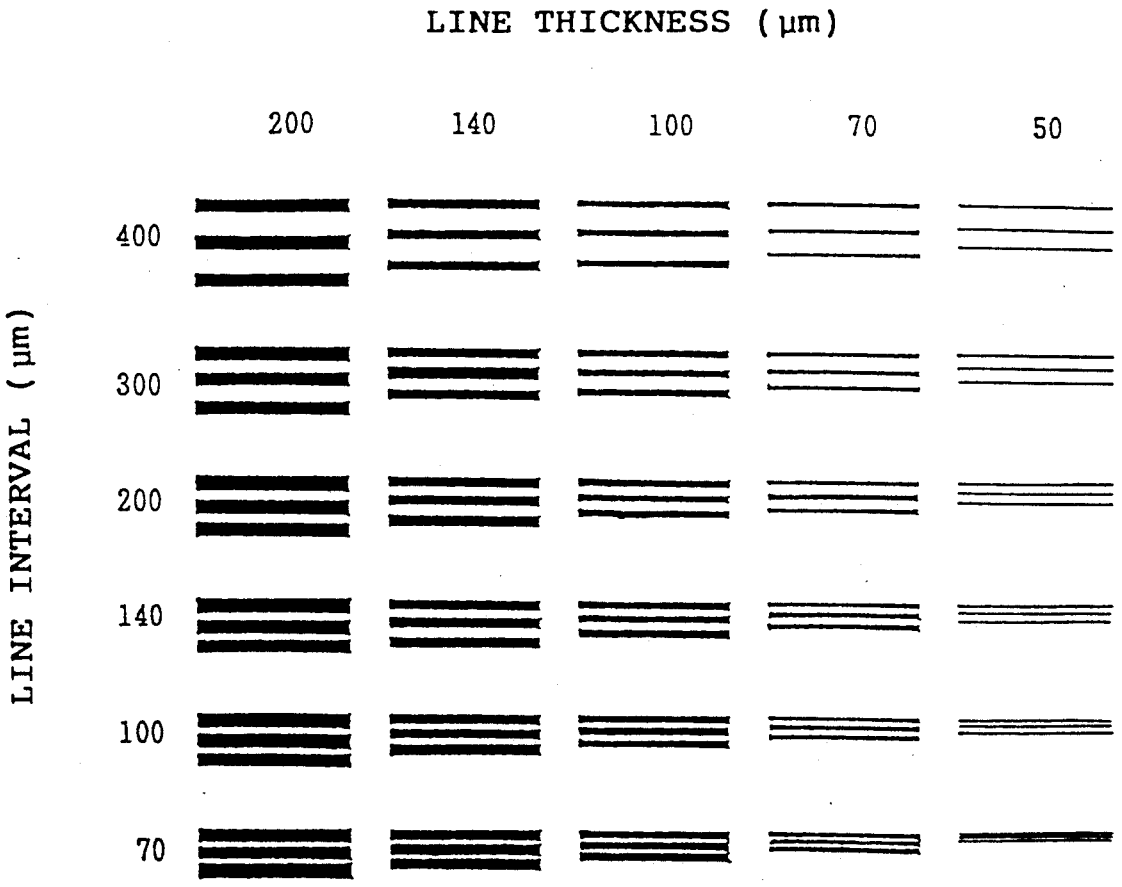
FIG. 6 is a test chart for use in image-development test which contains plurality of parallel line groups.

Image-formation was performed with the use of each of the developer samples Nos. 1 to 24 in the same manner as in Experiment 1, wherein a test chart containing multiple minute lines which is shown in FIG. 6 was used as the original for reproduction.

The copied image obtained in each case was examined with respect to its image density (optical density) by the use of a reflection densitometer (Macbeth RD 914) to obtain the value shown in Table 2.

Likewise, the resultant copied image obtained in each case was examined with respect to line width deviation (δ) of the image by the following method to obtain the value shown in Table 2.

The method of examining the line width-deviation (δ) of a copied image had been established by Mita Industrial Co., Ltd. In this method, there is used the test chart shown in FIG. 6. The test chart comprises 30 parallel line groups wherein 5 parallel line groups are arranged in the horizontal direction and 6 parallel line groups are arranged in the longitudinal direction, each parallel line group comprising 3 linear lines of the same length and the same thickness being arranged at regular intervals and in parallel to each other as shown in FIG. 6. In every 6 parallel line groups belonging to the same longitudinal row, all the linear lines are the same in the line thickness. In every 5 parallel line groups belonging to the same horizontal row, the interval between every the two lines is constant. The line thicknesses of the 5 parallel line groups belonging to the horizontal row are made 200, 140, 100, 70 and 50 μm respectively from the left to the right. The intervals between every the two linear lines for the 6 parallel line groups in the longitudinal row are made 400, 300, 200, 140, 100 and 70 μm respectively from the top to the bottom.

This test chart is set to the electrophotographic copying machine such that the parallel lines of the test chart are in parallel to the rotary axis of the photosensitive drum and the test chart is reproduced. The resultant reproduced is set to a commercially available SAKURA microdensitometer (product by KONICA Kabushiki Kaisha) which is capable of detecting the density of a thin line having a thickness less than the thickness of the thinnest line of the test chart, wherein the detecting area is adjusted to an area of 5 μm×1 mm and one of the 30 parallel line groups as reproduced is crosswise scanned, to thereby observe changes of the density in the perpendicular direction.

Figure 7A:
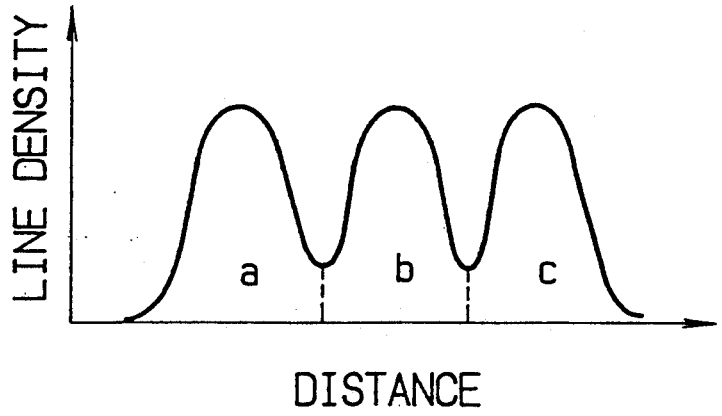
FIGS. 7(*a*) to 7(*c*) show graphs respectively illustrating the interrelation between the distance of the developer to proceed and the image density (optical density) of the close minute line images reproduced from the test chart shown in FIG. 6.
Figure 7B:
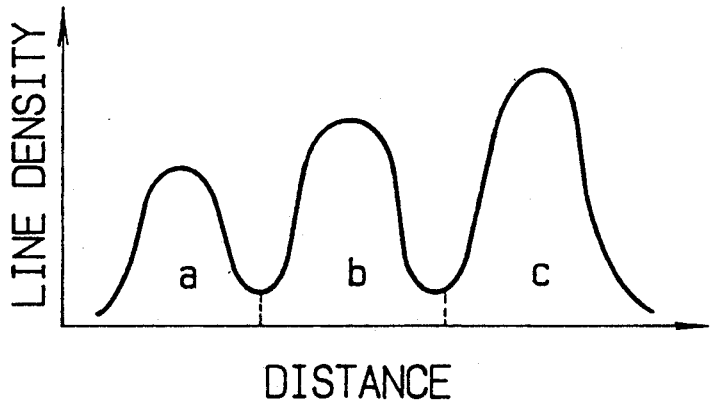
Figure 7C:
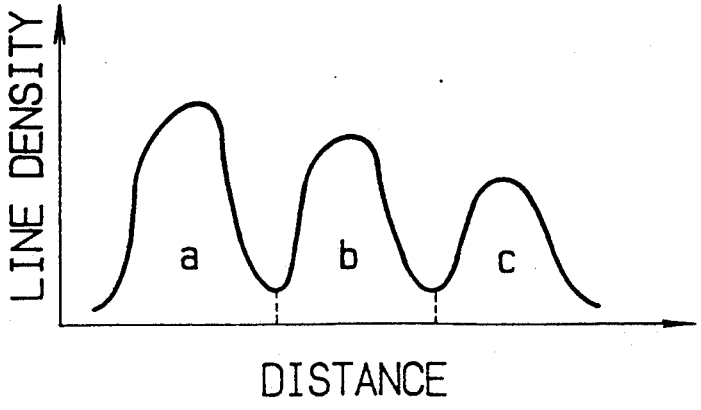

The density changes thus observed were plotted in relation with the scanning direction to thereby obtain density distribution graphs as shown FIGS. 7(*a*) to 7(*c*).

On the basis of these graphs obtained, the line evennesses [the line width deviation (δ)] of the parallel line group as reproduced is calculated by the equation: $\delta=(b+c)/(a+b)\times 100$.

FIG. 7(*a*) shows the situation of the reproduced parallel line group wherein the width of each reproduced line is constant and equivalent to the original line without any missing defect at the top portion or the end portion of the line. FIG. 7(*b*) shows the situation of the reproduced parallel line group wherein a significant missing defect is found at the top portion of the line. FIG. 7(*c*) shows the situation of the reproduced parallel line group wherein a significant missing defect is found at the end portion of the line.

From the results obtained in the above manner, a mean value of the δ for each parallel line group is obtained and the reproduced image is totally evaluated based on the resultant value of the δ. Specifically, the case where the δ is in the range of 80 to 120 is considered to be satisfactory. The case where the δ is less than 80 is considered to be unsatisfactory because there is a distinguishable missing defect at the end portion of the line. And the case where the is beyond 120 is considered to be unsatisfactory because there is a distinguishable missing defect at the top portion of the line.

In general, there is a tendency that a missing defect at the top portion of the line is likely to occur in the reverse developing system wherein the developing sleeve and the photosensitive drum proceed oppositely each other at the developing region. And there is a tendency that a missing defect at the end portion of the line is likely to occur in the forward developing system wherein the developing sleeve and the photosensitive drum proceed in the same direction.

In addition, the resultant copied image obtained in each case was evaluated totally based on the resultant value of the image density and the resultant value of the line width deviation (δ). The evaluated result was shown in Table 2 by the mark "○"or "X". The mark "○" means the case which has a line width deviation (δ) in the range of from 80 to 120 and has an image density of more than 1.25. The mark "X" means the case which has a line width deviation (δ) of less than 80 or more than 120, or has an image density of less than 1.25.

Figure 4:
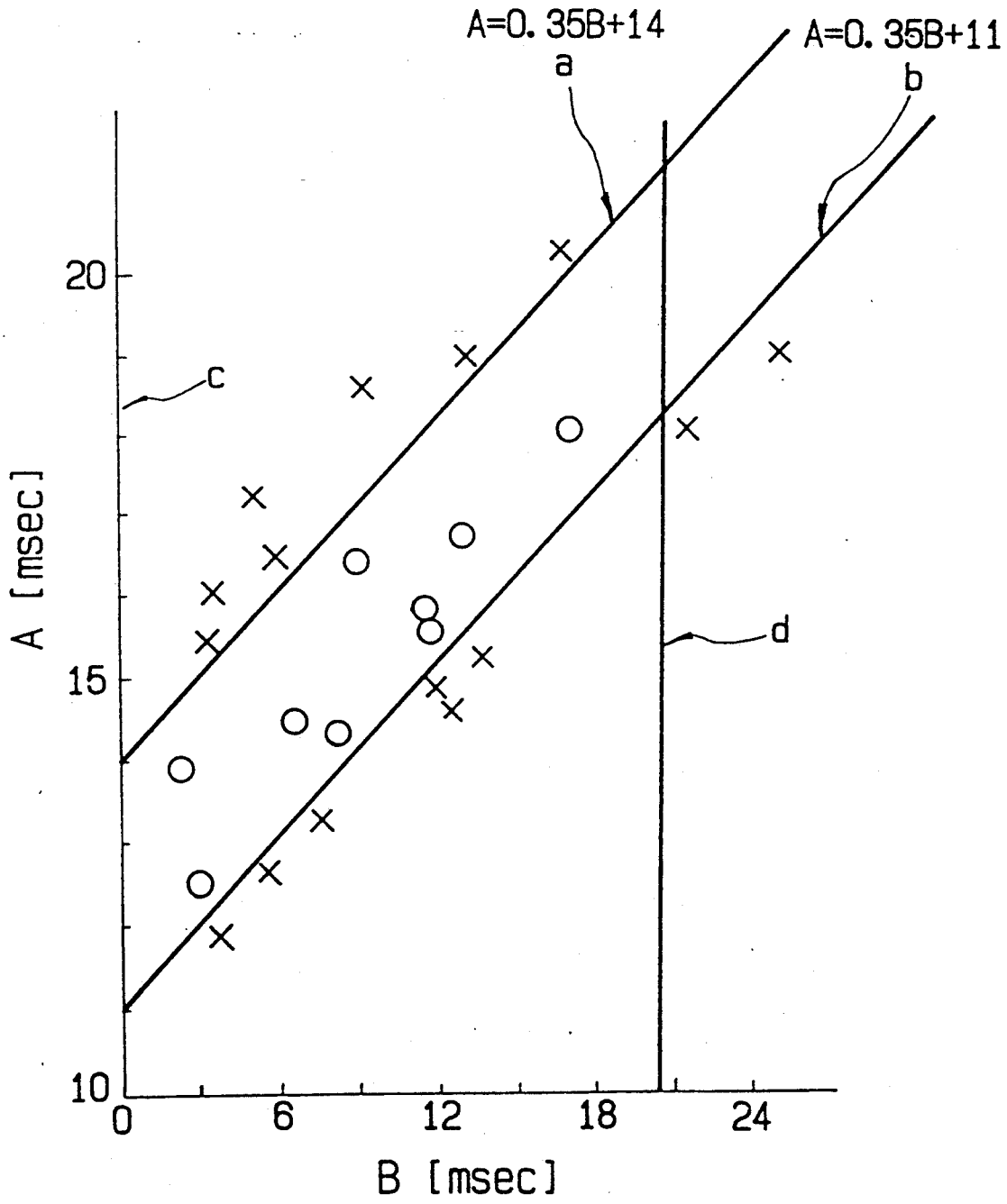
FIG. 4 collectively shows the interrelations among the relaxation times of the magnetic carrier particles, the relaxation times of the developers and the evaluated results on the resultant images reproduced.

The evaluated results shown in Table 2 were collectively shown in FIG. 4 with relation to the relaxation time A of the developer sample in a dynamic state and the relaxation time B of the resin-coated carrier sample thereof in a dynamic state. And there were obtained four linear lines a, b, c and d as shown in FIG. 4. The line a is corresponding to the equation: $A=0.35B+14$. The line b is corresponding to the equation: $A=0.35B+11$. The line c is corresponding to the equation: $B=0$. And the line d is corresponding to the equation: $B=20$.

Not only from what shown in FIG. 4 but also other experimental results obtained as a result of further studies by the present inventors, there were found the following facts: (i) when the two-component developer is such that has a relaxation time A when it is situated in a dynamic state which satisfies the equation: $0.35B+11<A<0.35B+14$ with B being a relaxation time of the resin-coated magnetic carrier thereof in a dynamic state and being greater than zero but smaller than 20, desirable high quality copied images excelling in the resolution of minute lines and also in the image density; (ii) even if a resin-coated magnetic carrier having a relaxation time of more than 20 when it is situated in a dynamic state, the relaxation time of the resulting developer in a dynamic state does not become greater as desired depending upon said magnetic carrier; (iii) in the case where the developer is such that has an excessively small relaxation time when it is situated in a dynamic state, the exaggeration factor of the developing electric field of the developer as a whole due to its relaxation time surpasses the toner take-up power of the magnetic carrier component and allows excessive transference of toner to the latent image formed on the photosensitive drum and because of this, the resulting images become such that are accompanied by unevennesses in density and poor in reproduction and resolution of the minute lines; and (iv) in the case where the developer is such that has a relaxation time when it is situated in a dynamic state which does not satisfies the foregoing equation, the toner component is dominant with respect to said relaxation time of the developer to cause negative influences of electrical and phisical environments which result in hindering transference of toner to the latent image, whereby providing copied images which are poor in reproduction and resolution of the minute lines.

Experiment 4

Observation was made on the resin-coated carrier samples Nos. 4 and 23 which were provided negative results in Experiment 3.

There was prepared a two-component developer having a toner content of 4.5% by weight and a relaxation time of 16.7 when it is situated in a dynamic state by mixing the resin-coated carrier sample No. 4 and the toner sample 3 obtained in Experiment 1.

Likewise, there was prepared a two-component developer having a toner content of 2.0% by weight and a relaxation time of 13.1 when it is situated in a dynamic state.

Then, image-formation was performed with the use of each of the resultant two developers in the same manner as in Experiment 1, wherein the test chart shown FIG. 6 was used as the original for reproduction.

As a result of examining the copied images obtained in each case, it was found that the value of the line width deviation was increased to 86.3 in the former case and 85 in the latter case.

Not only from these results but also from the foregoing experimental results, it was recognized that a two-component developer which contains magnetic carrier particles having a relaxation time B satisfying the equation: $O<B<20$ and which has a relaxation time A satisfying the equation: $0.35B+11<A<0.35B+14$ stably provides desirable high quality copied images excelling not only in image density but also in reproduction and resolution of the minute lines.

Experiment 5

Figure 5:
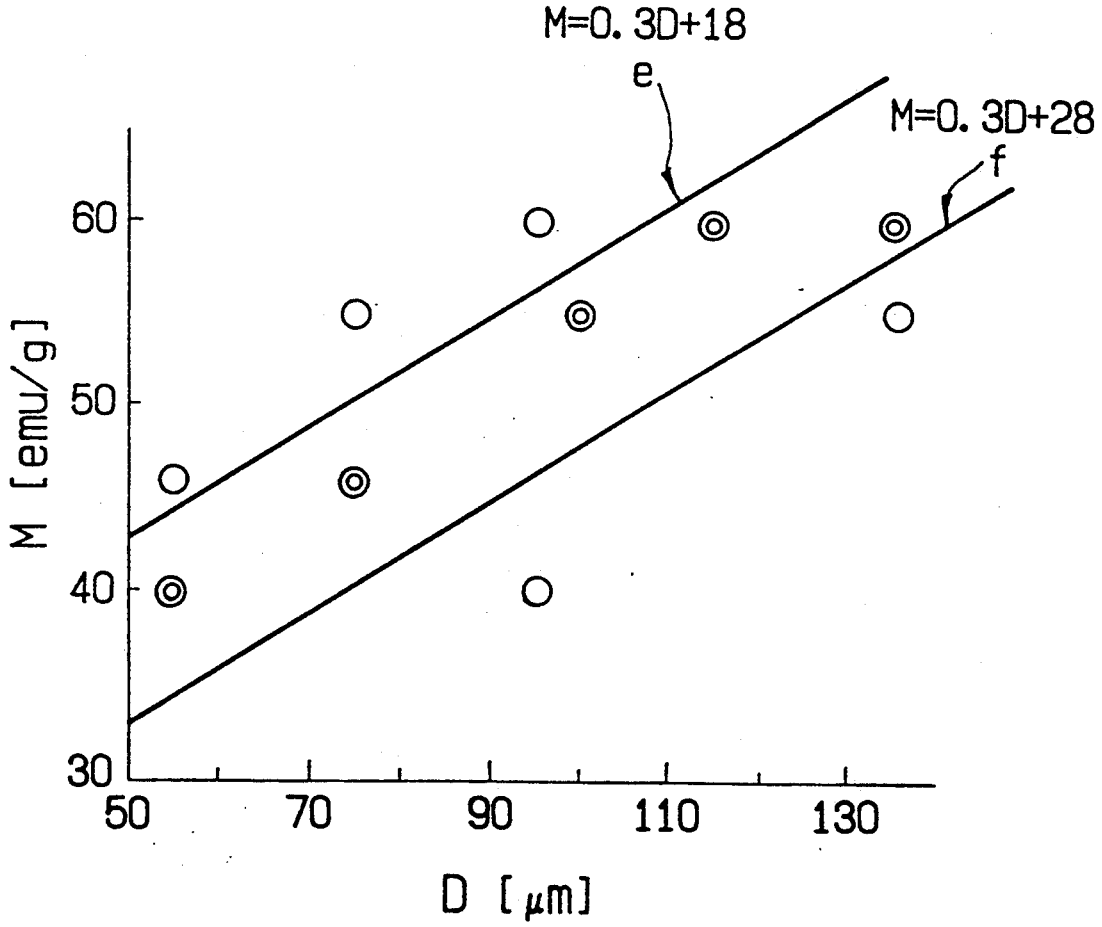
FIG. 5 collectively shows the interrelations among the mean particle sizes of the magnetic carrier particles, the saturation magnetizations of said particles and the evaluated results on the resultant images reproduced.

The resin-coated carrier particle samples which provided satisfactory results when used in combination with the toner samples in Experiment 3 were plotted with interrelation to the particle size D (μm) and the saturation magnetization M (emu/g) as shown in FIG. 5, wherein the resin coated carrier particle samples which provided high quality copied images having an image density of more than 1.3 and a line width deviation of more than 85 were expressed respectively by the mark "◎" and the remaining resin-coated carrier particle samples were expressed respectively by the mark "○".

In view of the interrelations among the plotted marks in the graph of FIG. 5, there were obtained a linear line e corresponding to the equation: $M=0.3D+18$ and a linear line f corresponding to the equation: $M=0.3D+28$.

As a result of further studies based on these two linear lines obtained, it was found that when magnetic carrier particles having a saturation magnetization M which satisfies the equation: $0.3D+18<M<0.3D+28$ is used as a magnetic carrier component of a two-component developer, the resulting two-component developer becomes such that the physical factors of the magnetic carrier component in the developing region such as the frequency of said carrier component to contact with the photosensitive drum, the state of scratching off the toner adhered on said photosensitive drum by pressure, etc. become to be in desirable states and that provides high quality copied images.

As apparent from what described in the above, the two-component developer of the present invention is inclusively specified by the relaxation time A when it is situated in a dynamic state, which satisfies the foregoing equation: $0.35B+11<A<0.35B+14$ with B being greater than zero (0) but less than 20, wherein B represents the relaxation time of the magnetic carrier component of said developer.

Said relaxation time A of the two-component developer of the present invention can be adjusted as desired by properly varying the capacitive component (C) and the resistant medium (R) to be used in combination. For instance, the relaxation time A can be heightened by increasing the amount of the capacitive component (C) or the resistant medium (R). And the relaxation time A can be reduced by decreasing the amount of the capacitive component (C) or the resistant medium (R). In any case, it is a matter of course that due regards are to be made on the shape, particle size, specific resistance, and dielectric constant not only for the magnetic carrier component but also for the toner component, and further due regards are to be made on the mixing ratio of the magnetic carrier component and the toner component.

In the following, explanation is to be made about the magnetic carrier particles (hereinafter referred to as "magnetic carrier component") and the toner particles (hereinafter referred to as "toner component") to constitute the two-component developer of the present invention.

Magnetic Component

The magnetic component is an important factor to make the two-component developer of the present invention to be desirable one which is capable of providing image-developing characteristics as desired in the electrophotographic image-forming process.

The magnetic component to be used in the present invention comprises a magnetic core particle having a resin coat applied on the surface thereof.

Said magnetic core particle comprises a ferrite particle substantially in spherical shape which has a saturation magnetization preferably in the range of from 30 to 70 emu/g or more preferably in the range of from 40 to 60 emu/g and has a mean particle size preferably in the range of from 20 to 140 μm or more preferably in the range of from 50 to 100 μm.

The magnetic component comprising said magnetic core particle having the resin coat is required to have a dielectric constant preferably in the range of from 4 to 15 or more preferably in the range of from 5 to 9 and a volume resistivity preferably in the range of from $5\times10^9$ to $5\times10^{11}$ or more preferably in the range of from $4\times10^{10}$ to $1\times10^{11}$ ωcm.

In addition to these requirements said magnetic component is required to have a relaxation time B which satisfies the equation: $0<B<20$.

Usable as the ferrite to be the magnetic core particle of the magnetic component are ferrites containing one or more elements selected from the group consisting of Cu, Zn, Mg, Mn and Ni. Among these ferrites, ferrites composed of Cu, Zn and Mg are the most desirable.

Other than these ferrites, it is possible to use other commercially available ferrites such as $ZnFe_2O_4$, $Y_3Fe_5O_{12}$, $CdFe_2O_4$, $CdFe_5O_{12}$, $PbFe_{12}O_{19}$, $NiFe_2O_4$, $NdFeO_3$, $BaFeO_{12}O_{19}$, $MgFe_2O_4$, $MnFe_2O_4$, $LaFeO_3$, etc.

In any case, the magnetic core particle may be comprised of one or more kinds selected from those ferrites mentioned above.

The foregoing relaxation time of the magnetic component is decided depending upon the kind and the amount of a coating resin applied on the surface of the magnetic core particle.

In practice, as for the amount of the coating resin applied on the surface of the magnetic core particle, it should be preferably in the range of from 0.5 to 30 parts by weight or more preferably, in the range of from 0.8 to 1.5 parts by weight respectively on the basis of a dry weight, versus 100 parts by weight of the ferrite constituting the magnetic core particle.

In view of this, when a given coating resin is applied on the surface of the magnetic core particle in order to form a resin coat on the surface of the magnetic core particle, the amount of said coating resin applied should be decided to be in the above range so that the resulting magnetic component results in having a relaxation time B to satisfy the equation: $O<B<20$ when it is situated in the foregoing dynamic state.

Usable as the coating resin are silicone resin, fluorine plastic, acrylic resin, styrene resin, styreneacryl resin, olefin resin, ketone resin, phenol resin, xylene resin, diallyl phthalate resin, etc.

Among these resins, straight silicone resin is the most desirable. Specific examples of said straight silicone resin are net-structured silicone resins comprising organopolysiloxane such as dimethylpolysiloxane, diphenylsiloxane or methylphenylpolysiloxane. Said netsturctured silicone resins may be obtained by incorporating hydrolyzable functional group such as trimethoxy group or other functional group such as silanol group into the organopolysiloxane unit, if necessary followed by hydrolysis, and contacting the resultant with a condensation catalyst.

These resins may be used singly or in combination of two or more of them.

Toner Component

The toner component comprising toner particles to be used in combination of the foregoing magnetic component to obtain the two-component developer of the present invention is required to have a specific dynamic state relaxation time such that makes the resulting two-component developer comprised of the foregoing magnetic component and the toner component to satisfy the equation: $0.35B+11<A<0.35B+14$. In view of this, there are selectively used materials having a relatively large static conductivity and a relatively large dielectric constant in order to prepare said toner component.

In a preferred embodiment for the preparation of the toner component, there are selectively used a carbon black excelling in conductivity in a relatively large amount and a toner resin having a relatively low electrical resistivity.

Usable as such toner resin are polar group-containing resins such as acrylic resin and acryl-styrene copolymer resin.

Specific examples of said acrylic resin are resins comprising acrylic monomer of the formula (1):

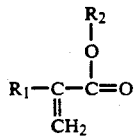

(1)

, wherein $R_1$ is hydrogen atom or a lower alkyl group, $R_2$ is hydrogen atom or an alkyl group containing up to 18 carbon atoms.

Specific examples of said acrylic monomer are ethyl acrylate, methyl methacrylate, butyl acrylate, butyl methacrylate, 2-ethylhexyl acrylate, 2-ethylhexyl methacrylate, acrylic acid, methacrylic acid, etc.

Other than these, said acrylic monomer may be ethylenic unsaturated carboxylic acids, anhydrides of said carboxylic acids such as maleic acid, crotonic acid, itaconic acid or anhydrides of these acids.

Specific examples of said acryl-styrene copolymer are resins comprising the foregoing acrylic monomer represented by aforesaid formula (1) and styrenic monomer of the formula (2):

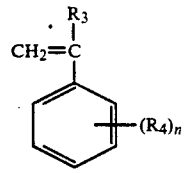

(2)

, wherein $R_3$ is hydrogen atom, a lower alkyl group having 1 to 4 carbon atoms, or halogen atom, $R_4$ is a lower alkyl group or halogen atom, and n is an integer of 2 or more.

Specific examples of said styrenic monomer are styrene, vinyltoluene, Δ-methylstyrene, Δ-chlorostyrene, vinylxylene and vinylnaphthalene, among these, styrene being the most desirable.

Any of the foregoing resins is desired to be of an oxidation number preferably in the range of from 0 to 25 or more preferably, in the range of from 5 to 10.

As for the foregoing carbon black to be used for the toner component of the two-component developer of the present invention, it is desired to use one that has a large structure-forming ability and a high surface purity. The carbon black having a large structure-forming ability means such a carbon black that is minute in particle size, has a large BET relative surface, for example, of more than 50 $m^2/g$, is large in oil absorption and is capable of providing a chain structure or a fringed-micelle structure within the toner resin.

The amount of the highly conductive carbon black to be incorporated into the toner component is preferably in the range of from 2 to 20 parts by weight or more preferably in the range of from 5 to 10 parts by weight respectively versus 100 parts by weight of the toner resin.

The toner component to constitute the two-component developer of the present invention may contain a relevant charge controlling agent. The charge controlling agent can include oil soluble dyes such as nigrosine base (CI 50415), spiron black (CI 26150), etc.; metal complex salt dyes of the 1:1 type or the 2:1 type; naphthenic metal salts; fatty acid soaps; and resinic acid soaps.

The toner particles to constitute the toner component of the present invention are desired to range in median diameter preferably from 8 to 14 μm or more preferably from 10 to 12 μm when measured by a coalter counter. The toner particles may be of undefined shapes obtained by a melt-blending pulverization method or of spherical shapes obtained by a dispersion or suspension polymerization method.

Two-Component Developer

The two-component developer according to the present invention comprises the foregoing magnetic component and the foregoing toner component and is specified by having a dynamic state relaxation time A which satisfies the foregoing equation: $0.35B+11<A<0.35B+14$.

The two-component developer according to the present invention is prepared by mixing a magnetic component selected from the magnetic components mentioned above and a toner component selected from the toner components mentioned above with the mixing ratio which has been predetermined while considering the characteristics and the dynamic state relaxation times of the two components to be mixed so that the resulting two-component has a dynamic state relaxation time A to satisfy the above equation.

In general, the mixing ratio of the magnetic component to the toner component in order to obtain the two-component developer of the present invention should be decided preferably in the range of from 99:1 to 90:10, more preferably in the range of from 98:2 to 95:5 respectively in terms of the quantitative mixing ratio.

The two-component developer of the present invention can be used in any of the known electrophotographic copying systems in which a two-component developer is used for image reproduction. And in any case, there can be stably provided high quality copied images excelling in resolution, tone reproduction and image density. The two-component developer of the present invention provides significant effects when an original containing multiple minute lines such as complicated chinese characters is used for reproduction. That is, there can be stably and repeatedly obtained high quality images equivalent to the original in which those complicated chinese characters of the original are desirably reproduced with high resolution and in high image density without any missing part.

TABLE 1

| Sample No. | 1 | 2 | 3 | 4 | 5 | 6 | 7 | 8 |
|---|---|---|---|---|---|---|---|---|
| ferrite particle | | | | | | | | |
| current value [μA] | 0.33 | 0.35 | 0.25 | 0.70 | 0.31 | 0.34 | 1.40 | 0.40 |
| saturation magnetization [emu/g] | 40 | 55 | 40 | 40 | 46 | 40 | 40 | 55 |
| mean particle size [μm] | 100 | 135 | 95 | 100 | 75 | 55 | 100 | 75 |
| resistivity [Ω-cm] | $3.6 \times 10^{10}$ | $3.3 \times 10^{10}$ | $3.8 \times 10^{10}$ | $1.0 \times 10^{10}$ | $3.5 \times 10^{10}$ | $2.5 \times 10^{10}$ | $7.6 \times 10^{9}$ | $7.8 \times 10^{9}$ |
| dielectric constant [−] | 6.09 | 6.07 | 6.22 | 6.72 | 6.14 | 6.03 | 7.41 | 7.82 |
| coating resin | A | SI | ST | F | A | ST-A | A | ST-A |
| coating amount [wt. %] | 1.32 | 1.25 | 0.86 | 1.54 | 0.94 | 1.13 | 1.98 | 2.01 |
| relaxation time [msec] | 17.0 | 13.2 | 21.0 | 9.3 | 17.3 | 13.0 | 5.1 | 6.0 |

| Sample No. | 9 | 10 | 11 | 12 | 13 | 14 | 15 | 16 |
|---|---|---|---|---|---|---|---|---|
| ferrite particle | | | | | | | | |
| current value [μA] | 0.49 | 0.44 | 2.02 | 2.04 | 0.51 | 0.80 | 0.33 | 0.43 |
| saturation magnetization [emu/g] | 55 | 59 | 60 | 60 | 55 | 60 | 40 | 40 |
| mean particle size [μm] | 95 | 115 | 115 | 100 | 135 | 135 | 115 | 95 |
| resistivity [Ω-cm] | $1.5 \times 10^{10}$ | $2.2 \times 10^{10}$ | $5.0 \times 10^{9}$ | $5.3 \times 10^{9}$ | $2.1 \times 10^{10}$ | $1.2 \times 10^{10}$ | $4.7 \times 10^{10}$ | $1.7 \times 10^{10}$ |
| dielectric constant [−] | 6.86 | 5.82 | 8.33 | 8.32 | 5.79 | 6.24 | 6.13 | 6.01 |
| coating resin | SI | A | ST-A | A | F | ST | F | A |
| coating amount [wt. %] | 1.32 | 1.23 | 2.23 | 2.34 | 1.04 | 0.75 | 1.67 | 1.52 |
| relaxation time [msec] | 9.0 | 11.5 | 3.6 | 3.3 | 11.7 | 6.5 | 25.3 | 13.8 |

| Sample No. | 17 | 18 | 19 | 20 | 21 | 22 | 23 | 24 |
|---|---|---|---|---|---|---|---|---|
| ferrite particle | | | | | | | | |
| current value [μA] | 0.45 | 0.38 | 0.74 | 1.20 | 1.30 | 0.52 | 1.30 | 2.10 |
| saturation magnetization [emu/g] | 60 | 46 | 55 | 46 | 60 | 55 | 55 | 55 |
| mean particle size [μm] | 100 | 55 | 75 | 55 | 95 | 75 | 100 | 100 |
| resistivity [Ω-cm] | $2.2 \times 10^{10}$ | $2.5 \times 10^{10}$ | $1.5 \times 10^{10}$ | $5.8 \times 10^{10}$ | $5.1 \times 10^{9}$ | $1.2 \times 10^{10}$ | $7.3 \times 10^{9}$ | $5.2 \times 10^{9}$ |
| dielectric constant [−] | 5.78 | 5.81 | 6.44 | 8.56 | 7.23 | 6.89 | 7.84 | 8.31 |
| coating resin | A | ST | SI | F | A | ST-A | SI | ST |
| coating amount [wt. %] | 1.48 | 1.67 | 0.99 | 0.88 | 0.73 | 2.13 | 0.68 | 0.54 |
| relaxation time [msec] | 12.0 | 12.6 | 8.2 | 2.6 | 3.0 | 7.6 | 5.5 | 3.6 |

Note
A: acrylic resin (MMA-BA copolymer)
SI: silicon resin (straight silicone resin)
ST: styrene resin
F: fluorine resin (mixed resin of polyvinylidene chloride and st-MMA copolymer)
ST-A: styrene-acrylic resin (styrene-n-butylacrylate copolymer)

| Sample No. | 1 | 2 | 3 | 4 | 5 | 6 | 7 | 8 |
|---|---|---|---|---|---|---|---|---|
| magnetic carrier | | | | | | | | |
| core particle | | | | | | | | |

-continued

| | | | | | | | | |
|---|---|---|---|---|---|---|---|---|
| current value [μA] | 0.33 | 0.35 | 0.25 | 0.70 | 0.31 | 0.34 | 1.40 | 0.40 |
| saturation magnetization [emu/g] | 40 | 55 | 40 | 40 | 46 | 40 | 40 | 55 |
| mean particle size [μm] | 100 | 135 | 95 | 100 | 75 | 55 | 100 | 75 |
| resistivity [Ω-cm] | $3.6 \times 10^{10}$ | $3.3 \times 10^{10}$ | $3.8 \times 10^{10}$ | $1.0 \times 10^{10}$ | $3.5 \times 10^{10}$ | $2.5 \times 10^{10}$ | $7.6 \times 10^{9}$ | $7.8 \times 10^{9}$ |
| dielectric constant [−] | 6.09 | 6.07 | 6.22 | 6.72 | 6.14 | 6.03 | 7.41 | 7.82 |
| relaxation time [msec] | 17.0 | 13.2 | 21.0 | 9.3 | 17.3 | 13.0 | 5.1 | 6.0 |
| Toner Sample No. | 2 | 3 | 1 | 1 | 2 | 3 | 3 | 1 |
| T/D [wt. %] | 3.0 | 5.1 | 3.0 | 3.0 | 2.5 | 2.1 | 3.0 | 2.5 |
| developer | | | | | | | | |
| resistivity [Ω-cm] | $4.4 \times 10^{10}$ | $4.1 \times 10^{10}$ | $4.0 \times 10^{10}$ | $4.0 \times 10^{10}$ | $3.9 \times 10^{10}$ | $3.7 \times 10^{10}$ | $3.6 \times 10^{10}$ | $3.3 \times 10^{10}$ |
| dielectric constant [−] | 5.19 | 5.34 | 5.36 | 5.27 | 5.29 | 5.16 | 5.42 | 5.61 |
| relaxation time [msec] | 20.3 | 19.0 | 17.8 | 18.5 | 18.0 | 16.7 | 17.2 | 16.5 |
| image density [J.D.] | 1.230 | 1.241 | 1.235 | 1.332 | 1.358 | 1.303 | 1.389 | 1.377 |
| line width deviation [δ] | 83.2 | 82.0 | 89.1 | 77.9 | 85.2 | 85.3 | 75.2 | 73.5 |
| image evaluation | × | × | × | × | ○ | ○ | × | × |
| Sample No. | 9 | 10 | 11 | 12 | 13 | 14 | 15 | 16 |
| magnetic carrier | | | | | | | | |
| core particle | | | | | | | | |
| current value [μA] | 0.49 | 0.44 | 2.02 | 2.04 | 0.51 | 0.80 | 0.33 | 0.43 |
| saturation magnetization [emu/g] | 55 | 59 | 60 | 60 | 55 | 60 | 40 | 40 |
| mean particle size [μm] | 95 | 115 | 115 | 100 | 135 | 135 | 115 | 95 |
| resistivity [Ω-cm] | $1.5 \times 10^{10}$ | $2.2 \times 10^{10}$ | $5.0 \times 10^{9}$ | $5.3 \times 10^{9}$ | $2.1 \times 10^{10}$ | $1.2 \times 10^{10}$ | $4.7 \times 10^{9}$ | $1.7 \times 10^{10}$ |
| dielectric constant [−] | 6.86 | 5.82 | 8.33 | 8.32 | 5.79 | 6.24 | 6.13 | 6.01 |
| relaxation time [msec] | 9.0 | 11.5 | 3.6 | 3.3 | 11.7 | 6.5 | 25.3 | 13.8 |
| Toner Sample No. | 1 | 2 | 3 | 1 | 1 | 2 | 2 | 3 |
| T/D [wt. %] | 3.0 | 3.8 | 3.8 | 3.0 | 5.1 | 5.1 | 3.8 | 3.0 |
| developer | | | | | | | | |
| resistivity [Ω-cm] | $3.3 \times 10^{10}$ | $3.4 \times 10^{10}$ | $3.6 \times 10^{10}$ | $3.2 \times 10^{10}$ | $3.3 \times 10^{10}$ | $3.0 \times 10^{10}$ | $4.8 \times 10^{10}$ | $3.0 \times 10^{10}$ |
| dielectric constant [−] | 5.62 | 5.26 | 5.64 | 5.17 | 5.24 | 5.46 | 5.33 | 5.25 |
| relaxation time [msec] | 16.4 | 15.8 | 16.1 | 15.5 | 15.6 | 14.5 | 19.1 | 15.3 |
| image density [J.D] | 1.349 | 1.319 | 1.393 | 1.401 | 1.253 | 1.315 | 1.158 | 1.318 |
| line width deviation [δ] | 88.3 | 86.6 | 70.8 | 71.2 | 81.0 | 87.0 | 85.5 | 76.4 |
| image evaluation | ○ | ○ | × | × | ○ | ○ | × | × |
| Sample No. | 17 | 18 | 19 | 20 | 21 | 22 | 23 | 24 |
| magnetic carrier | | | | | | | | |
| core particle | | | | | | | | |
| current value [μA] | 0.45 | 0.38 | 0.74 | 1.20 | 1.30 | 0.52 | 1.30 | 2.10 |
| saturation magnetization [emu/g] | 60 | 46 | 55 | 46 | 60 | 55 | 55 | 55 |
| mean particle size [μm] | 100 | 55 | 75 | 55 | 95 | 75 | 100 | 100 |
| resistivity [Ω-cm] | $2.2 \times 10^{10}$ | $2.5 \times 10^{10}$ | $1.5 \times 10^{10}$ | $5.8 \times 10^{10}$ | $5.1 \times 10^{9}$ | $1.2 \times 10^{10}$ | $7.3 \times 10^{9}$ | $5.2 \times 10^{9}$ |
| dielectric constant [−] | 5.78 | 5.81 | 6.44 | 8.56 | 7.23 | 6.89 | 7.84 | 8.31 |
| relaxation time [msec] | 12.0 | 12.6 | 8.2 | 2.6 | 3.0 | 7.6 | 5.5 | 3.6 |
| Toner Sample No. | 1 | 3 | 2 | 1 | 3 | 1 | 3 | 2 |
| T/D [wt. %] | 3.0 | 2.1 | 2.5 | 2.1 | 3.0 | 2.5 | 3.0 | 3.0 |
| developer | | | | | | | | |
| resistivity [Ω-cm] | $3.1 \times 10^{10}$ | $3.2 \times 10^{10}$ | $2.9 \times 10^{10}$ | $2.7 \times 10^{10}$ | $2.6 \times 10^{10}$ | $2.5 \times 10^{10}$ | $2.5 \times 10^{10}$ | $2.3 \times 10^{10}$ |
| dielectric constant [−] | 5.31 | 5.30 | 5.50 | 5.89 | 5.51 | 5.72 | 5.77 | 5.79 |
| relaxation time [msec] | 14.8 | 14.6 | 14.3 | 13.9 | 12.5 | 13.3 | 12.7 | 11.9 |
| image density [J.D.] | 1.408 | 1.355 | 1.358 | 1.388 | 1.396 | 1.360 | 1.330 | 1.294 |
| line width deviation [δ] | 71.1 | 78.6 | 81.3 | 81.3 | 80.3 | 77.7 | 74.3 | 67.5 |
| image evaluation | × | × | ○ | ○ | ○ | × | × | × |

Note T/D: the amount of the toner/the amount of the developer

What we claim is:

1. An image developing method of forming a magnetic brush comprising a two-component developer containing magnetic carrier particles and electroscopic toner particles on a developing sleeve and contacting said magnetic brush formed on said developing sleeve with a latent image-supporting member having a latent image formed thereon to thereby visualize said latent image formed on said latent image-supporting member, characterized in that said magnetic carrier particles have a relaxation time B (msec) satisfying the equation: $0<B<20$ when they are situated in a dynamic state and said developer has a relaxation time A (msec) satisfying the equation: $0.35B+11<A<0.35B+14$ when it is situated in a dynamic state.

2. The image developing method according to claim 1, wherein said magnetic carrier particles are ones that satisfies the equation: $0.3D+18<M<0.3D+28$ with D being a mean particle size (μm) and M being a saturation magnetization (emu/g).

* * * * *